US009011263B2

(12) United States Patent
Brown et al.

(10) Patent No.: US 9,011,263 B2
(45) Date of Patent: Apr. 21, 2015

(54) PORTABLE MECHANICAL GOLF TEE DEVICE

(71) Applicants: Donald C. Brown, Tanjay (PH); Jesse E. Durgin, Uhrichsville, OH (US)

(72) Inventors: Donald C. Brown, Tanjay (PH); Jesse E. Durgin, Uhrichsville, OH (US)

(73) Assignee: Donald C. Brown (PH)

( * ) Notice: Subject to any disclaimer, the term of this patent is extended or adjusted under 35 U.S.C. 154(b) by 0 days.

(21) Appl. No.: 13/932,120

(22) Filed: Jul. 1, 2013

(65) Prior Publication Data

US 2014/0004966 A1 Jan. 2, 2014

Related U.S. Application Data

(60) Provisional application No. 61/666,954, filed on Jul. 2, 2012.

(51) Int. Cl.
*A63B 69/36* (2006.01)
*A63B 57/00* (2006.01)
*A63B 47/00* (2006.01)

(52) U.S. Cl.
CPC ..... *A63B 57/0006* (2013.01); *A63B 47/002* (2013.01)

(58) Field of Classification Search
CPC ..... A63B 57/0006; A63B 47/002
USPC ..... 473/132–137, 278, 279
See application file for complete search history.

(56) References Cited

U.S. PATENT DOCUMENTS

| | | | | | |
|---|---|---|---|---|---|
| 1,598,971 | A * | 9/1926 | Kenyon | 473/137 |
| 2,450,206 | A * | 9/1948 | Shouse | 473/133 |
| 2,711,321 | A * | 6/1955 | McGraw, Sr. | 473/137 |
| 2,789,824 | A * | 4/1957 | Willcox | 473/136 |
| 3,075,774 | A * | 1/1963 | Buell | 473/137 |
| 3,458,204 | A * | 7/1969 | Wilson | 473/134 |
| 3,901,515 | A * | 8/1975 | Mozel | 473/133 |
| 4,875,685 | A * | 10/1989 | Ballinger et al. | 473/279 |
| 4,995,614 | A * | 2/1991 | Tange | 473/137 |
| 5,259,622 | A * | 11/1993 | Irving | 473/132 |
| 5,346,222 | A * | 9/1994 | Luther, Sr. | 473/137 |
| 5,411,267 | A * | 5/1995 | Burks et al. | 473/133 |
| 5,611,737 | A * | 3/1997 | Rau et al. | 473/137 |
| 6,135,895 | A * | 10/2000 | Estivo et al. | 473/278 |
| 6,729,965 | B2 * | 5/2004 | Howard et al. | 473/134 |
| 7,059,969 | B2 * | 6/2006 | Howe et al. | 473/137 |
| 7,104,421 | B2 * | 9/2006 | Eckhardt et al. | 473/137 |
| 2004/0082398 | A1 * | 4/2004 | Gager | 473/131 |
| 2004/0229705 | A1 * | 11/2004 | Hollrock | 473/132 |

* cited by examiner

*Primary Examiner* — Steven Wong
(74) *Attorney, Agent, or Firm* — Dureska, Kennedy & Moore, L.L.C.; Brent L. Moore

(57) ABSTRACT

A portable, lightweight mechanical golf tee device includes a tee box, a golf ball reservoir that includes a container for a plurality of golf balls and a ball stop. The golf ball reservoir is connected to the tee box. The portable mechanical golf tee device includes a tee activation mechanism that is connected to the tee box and upon user actuation, the tee activation mechanism actuates a tee mechanism, the tee mechanism provides placement of the golf ball from the golf ball reservoir.

11 Claims, 7 Drawing Sheets

PORTABLE MECHANICAL GOLF TEE DEVICE

CROSS-REFERENCE TO RELATED APPLICATION

This application claims the benefit of U.S. Provisional Patent Application Ser. No. 61/666,954 filed Jul. 2, 2012.

BACKGROUND OF THE INVENTION

1. Field of the Invention

The invention relates generally to the art of mechanical golf tees that place a golf ball onto a tee, which is then capable of being hit by an individual using a golf club. More particularly, the present invention relates to a portable mechanical golf tee device that dispenses a single golf ball onto a tee and that raises the tee with the golf ball disposed thereon to a selected height so that the golf ball can then be hit by an individual utilizing a golf club.

2. Background Art

It can be appreciated that automatic golf tees have been in use for years. Typically, automatic golf tees include a golf ball reservoir, that houses all the balls for the unit. It helps guide the golf balls to the tee after the ball leaves the ball reservoir. It typically can be adjusted for proper releasing of the ball in case of unlevel surfaces. Some devices physically place a single golf ball on a stationary tee from a plurality of golf balls using an external power source to drive a motor and/or solenoids to achieve the desired effect. Other devices utilize photoelectric cells to monitor and control numerous switches to operate a mechanical apparatus to place the ball on the tee. U.S. Pat. No. 5,282,629 to Randall S. Eckstein is an example of an apparatus that incorporates air cylinders to sort out a single ball, physically lift it to the practice surface and place it on the tee. Some designs require digging large holes, pouring concrete, and embedding components in the ground in order to operate. U.S. Pat. No. 5,016,886 by Bobby J. Gould is an example of a golf tee device that requires a vacuum of air to drive various components. Most devices require movements by the golfer to control mechanical apparatuses to place the ball on the tee.

The main problem associated with prior art conventional automatic golf tee devices are that although most of the devices serve their purpose placing a golf ball on a stationary tee, the various designs use very sophisticated mechanical apparatuses and many use intricately machined and specialized parts to complete this task making the process of teeing up the ball much more complicated than necessary. Frequent maintenance is needed such as lubrication of the various parts and components. Otherwise, malfunctioning and jamming of the golf ball can occur, which takes away from the concentration and pleasure of the golfing experience of the user. Another problem with conventional prior art automatic golf tee devices, is that the weight of the devices is large, so that the devices are very heavy and cumbersome. Some of these prior art devices weigh in excess of several hundred pounds making easy portability nearly impossible without assistance from others or without use of loading equipment. The operator of the prior art automatic golf tee device must travel to a location where the device is already housed before the individual can use the device. This limits where the individual can use the device. This lack of accessibility greatly reduces the devices practical use for an ordinary individual who wishes to use the device in a short time without traveling. Users who are willing to spend a great deal of money can install one of these devices in their home, but cost can be a severely limiting factor for many people. Another problem with conventional prior art automatic golf tee devices is that many require a power source that must be applied to the device to provide the operation of sorting a single ball from a plurality of balls, and setting it on the stationary tee. Prior art designs include using onboard batteries with charging systems and/or requiring constant connection to standard 110 V wall sockets. These requirements severely limit the transportability of the device as they prohibit use of the device in locations where a power source is not available. Also, using the device with the power connected can potentially be a serious hazard to the operator if used in wet or rainy conditions.

Therefore, a need exists in the art for a golf tee device that overcomes problems associated with prior art golf tee devices. These problems are overcome by the portable mechanical golf tee device of the present invention that substantially departs from the conventional concepts and designs of the prior art, and provides an apparatus that allows a person to easily place a golf ball on a golf tee repeatedly by means of a simple human-powered device. The portable mechanical golf tee device of the present invention is easily transportable and simple to use, resulting in a device that is more enjoyable to utilize by the end user without need for the user to change their natural hitting stance while maintaining concentration on hitting the ball. The portable mechanical golf tee device of the present invention minimizes potential physical problems associated with users of prior art devices that require the user to bend over to tee the ball each time a ball is hit by the user. The portable mechanical tee device of the present invention eliminates the need for a power source, thereby making the invention "eco" and "green" friendly. This provides safety for the user by eliminating any shock hazard associated with utilizing the device in wet or damp conditions. The portable mechanical tee device of the present invention can be utilized either indoors or outdoors, or at any location where there is sufficient space to set up the device. Moreover, because the device is simple and lightweight, it can be easily moved by the golfer from one location to another without the need for assistance or additional lifting devices or aids.

SUMMARY OF THE INVENTION

Objectives of the present invention include providing a portable apparatus that allows a person to easily place a golf ball on a golf tee repeatedly by means of a simple human-powered device.

A further objective of the present invention is to provide an easily transportable and simple apparatus to provide enjoyment to the end user without the user changing their natural hitting stance while maintaining concentration on the ball.

Yet another objective of the present invention is to minimize potential physical problems associated with use of prior art devices that required the user to bend over to tee the ball each time a ball is hit.

Still another objective of the present invention is to eliminate the need for a power source, thereby making the invention "eco" and "green" friendly.

A further objective is of the present invention is to provide the user with the option to utilize the device indoors or outdoors or at any location where there is sufficient space to set up the device.

Yet another objective of the present invention is to provide the user to move the device from one location to another without the need for assistance or additional lifting devices or aids.

These objectives and advantages are obtained by the portable mechanical golf tee device of the present invention, which includes a tee box, a golf ball reservoir that includes a container for a plurality of golf balls and a ball stop. The golf ball reservoir is connected to the tee box. The portable mechanical golf tee device includes a tee activation mechanism that is connected to the tee box and upon user actuation, the tee activation mechanism actuates a tee mechanism, the tee mechanism provides placement of the golf ball from the golf ball reservoir.

BRIEF DESCRIPTION OF THE SEVERAL VIEWS OF THE DRAWINGS

The preferred embodiment of the present invention, illustrative of the best mode in which applicants have contemplated applying the principles, is set forth in the following description and is shown in the drawings, and is particularly and distinctly pointed out and set forth in the appended claims.

Similar numerals refer to similar parts throughout the drawings.

DESCRIPTION OF THE PREFERRED EMBODIMENT

Figure 1:
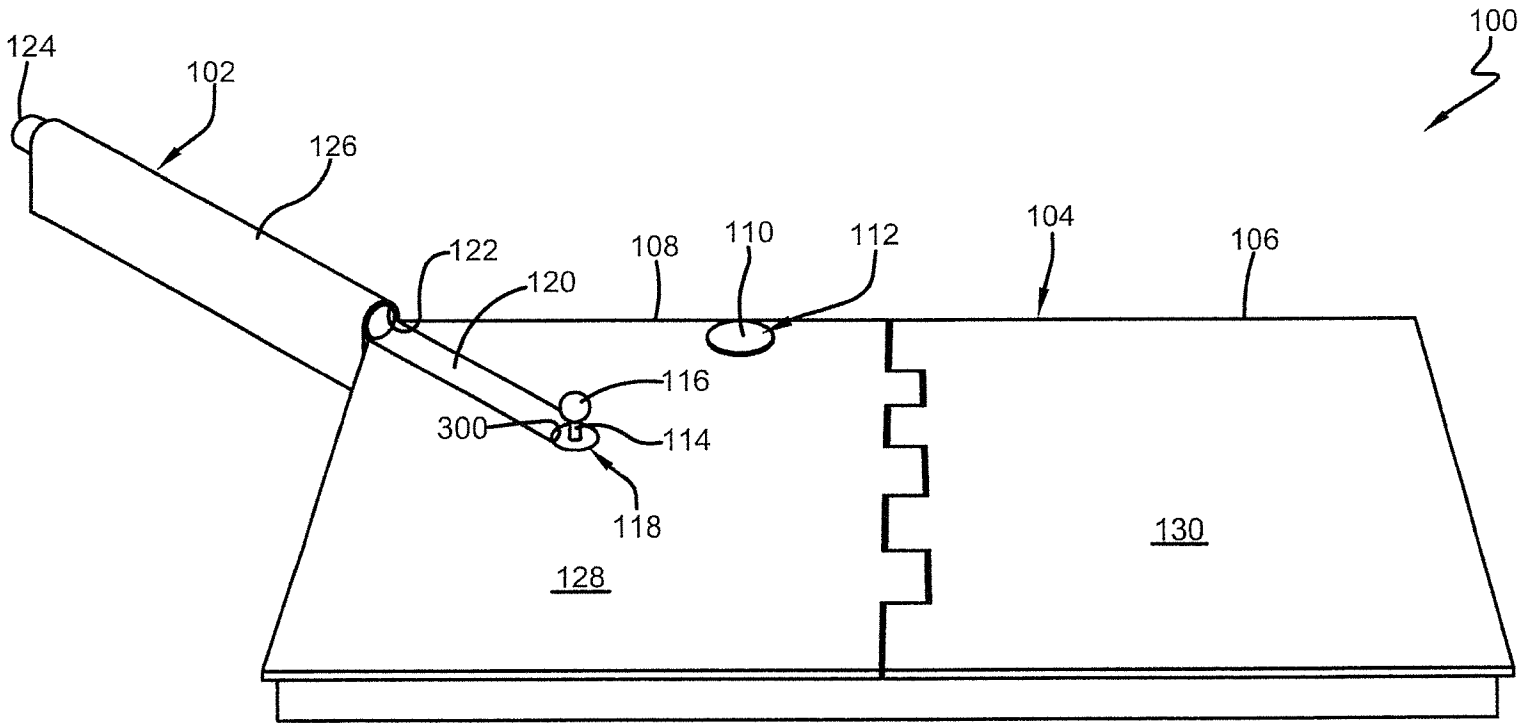
FIG. 1 is a top perspective view of a preferred embodiment portable mechanical golf tee device of the present invention showing the golf tee device including a golf ball reservoir, a tee area surface, and a golfer area surface.
Figure 2:
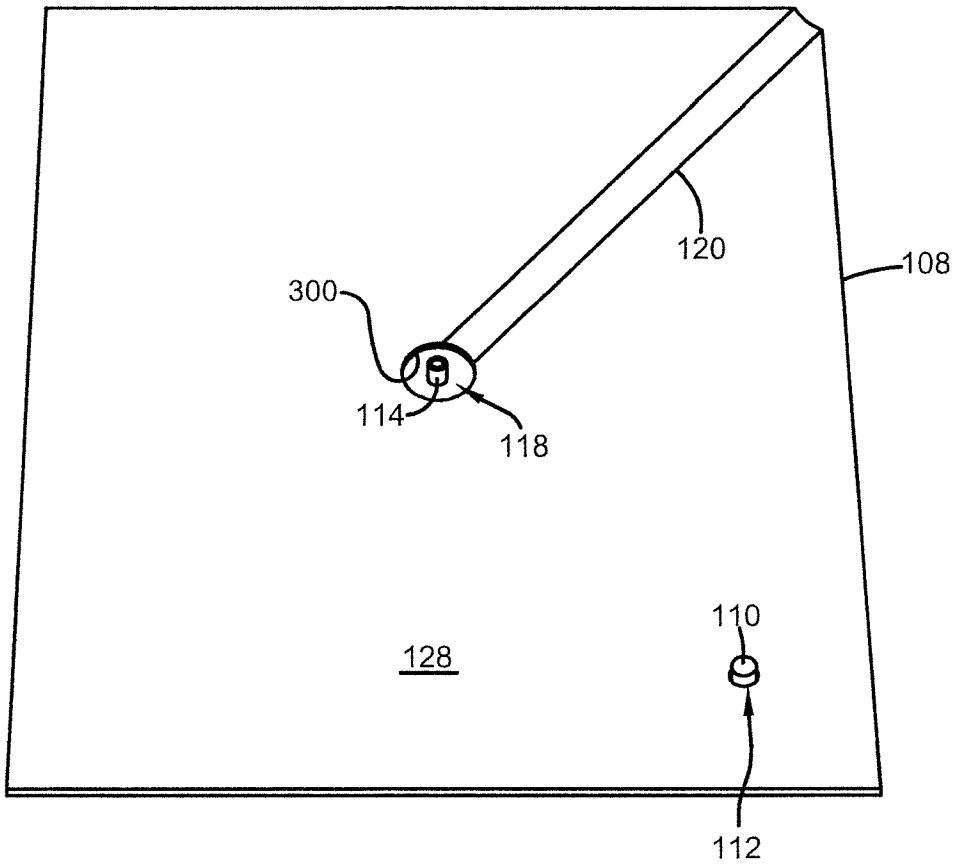
FIG. 2 is a top view of the preferred embodiment golf tee device shown in FIG. 1, showing the tee area surface and the golfer area surface.

Turning to FIGS. 1-2, a preferred embodiment golf tee device of the present invention is shown at reference numeral 100 and includes a tee box 104 and a golf ball reservoir 102. Tee box 104 is generally rectangular in shape and includes a golfer area 106 and a tee area 108 that are connected to one another by a hinge or series of hinges which allow the tee box to fold over onto itself for easy portability. Golfer area 106 is generally rectangular in shape and includes a golfer area surface 130 where the user generally stands. Golfer area surface 130 generally includes a covering that mimics the surface or grass of a golf course tee box and provides sufficient surface area for a user to practice their swing prior to activating golf tee device 100. Further, golfer area surface 130 provides sufficient traction when a user is following through after contact with a golf ball 116 preventing injuries due to falling and/or slipping. Golf ball reservoir 102 is a container for a plurality of golf balls 116 and will be discussed in further detail below.

Tee box 104 also includes tee area 108, a tee activation mechanism 112, a tee mechanism 118, and a tee area surface 128. Tee area 108 is generally rectangular in shape and includes golf ball tee 114 on which golf ball 116 is placed. Tee area surface 128 is formed with a channel 120, and a similar covering as golfer area surface 130, as to mimic a golf course tee box. In this manner, the user is able to practice on a similar type of ground as the user may experience if they were playing a round of golf on a golf course. Channel 120 of tee area surface 128 guides golf ball 116 once the golf ball is released from golf ball reservoir 102. Further, channel 120 may be a depressed area within tee area surface 128 to guide golf ball 116 to tee 114 when the golf ball is released. To release golf ball 116 from golf ball reservoir 102, the user actuates a plunger 110 of tee activation mechanism 112, which will release the golf ball, as will be discussed in greater detail below. Plunger 110 is generally circular in shape and is able to withstand the force of being depressed by the user's foot.

Figure 6:
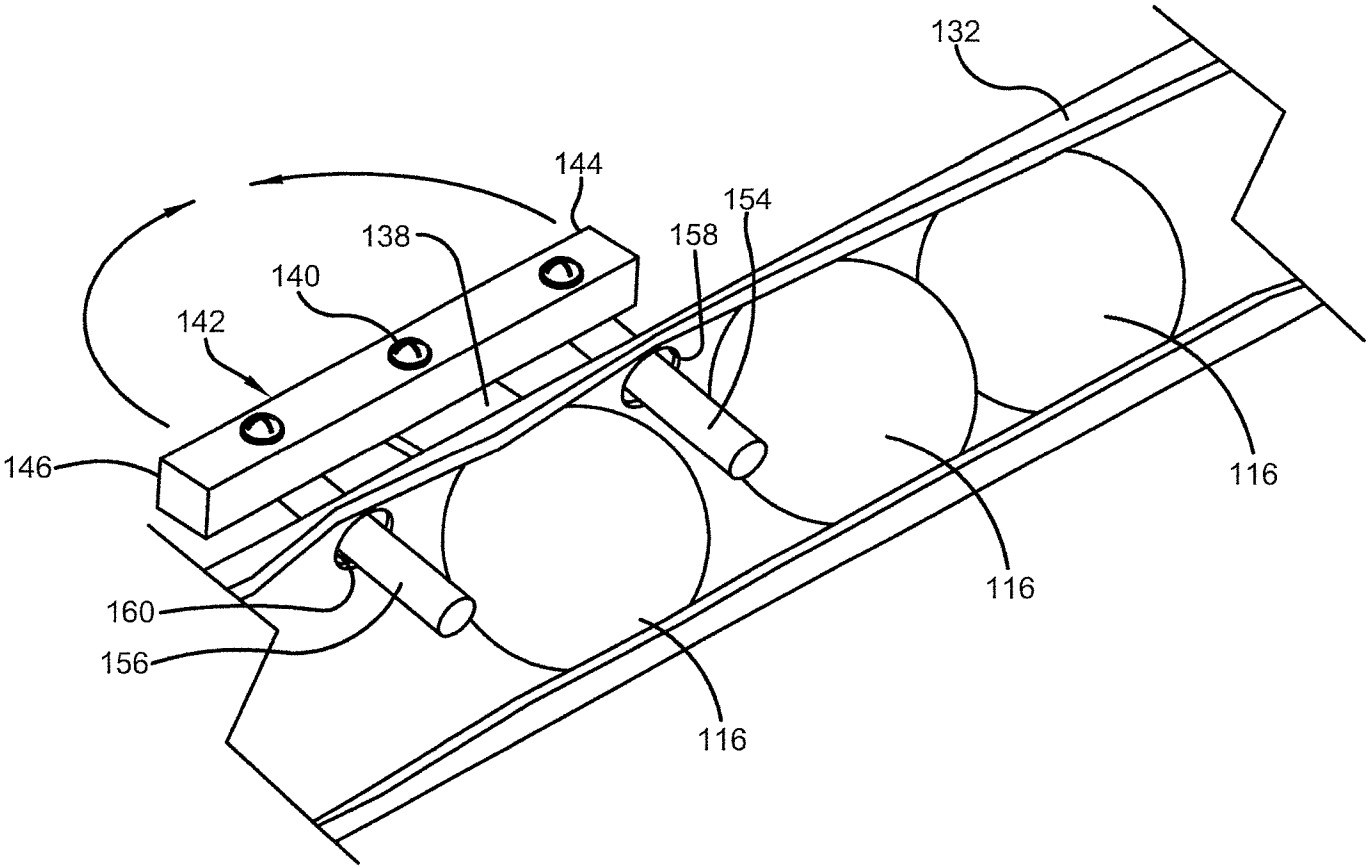
FIG. 6 is a perspective view, with portions broken away, showing the interaction of the pivoting ball stop and a plurality of golf balls.

Tee area 108 is attached to golf ball reservoir 102 by fasteners (not shown). Golf ball reservoir 102 is generally rectangular in shape and includes an opening 122, a ball inlet 124 and a ball reservoir cover 126. User places a plurality of golf balls 116, generally in a linear fashion, as shown in FIG. 6, into ball inlet 124, of golf ball reservoir 102. In this manner, user decides the amount of golf balls 116 to utilize for practice. Further, golf ball reservoir 102 includes ball reservoir cover 126 to protect plurality of golf balls 116 from dirt, water, and other external contaminants, prior to the golf ball exiting the golf ball reservoir via opening 122. In this manner, user is not required to wipe dirt, or other debris, off golf ball 116 before striking the golf ball.

Golf ball reservoir 102 is angled downwardly towards tee area 108. In this fashion, gravity allows golf ball 116 to exit via opening 122, guided by channel 120 towards tee 114. Channel 120 is an elevated surface of tee area surface 128 such that golf ball 116 rolls towards tee 114. Further, channel 120 extends from an edge of tee area surface 128 to tee 114. Even further, the angle of golf ball reservoir 102 provides golf ball 116 sufficient speed to traverse channel 120 to rest upon tee 114 of tee area 108 without surpassing the tee.

Figure 3:
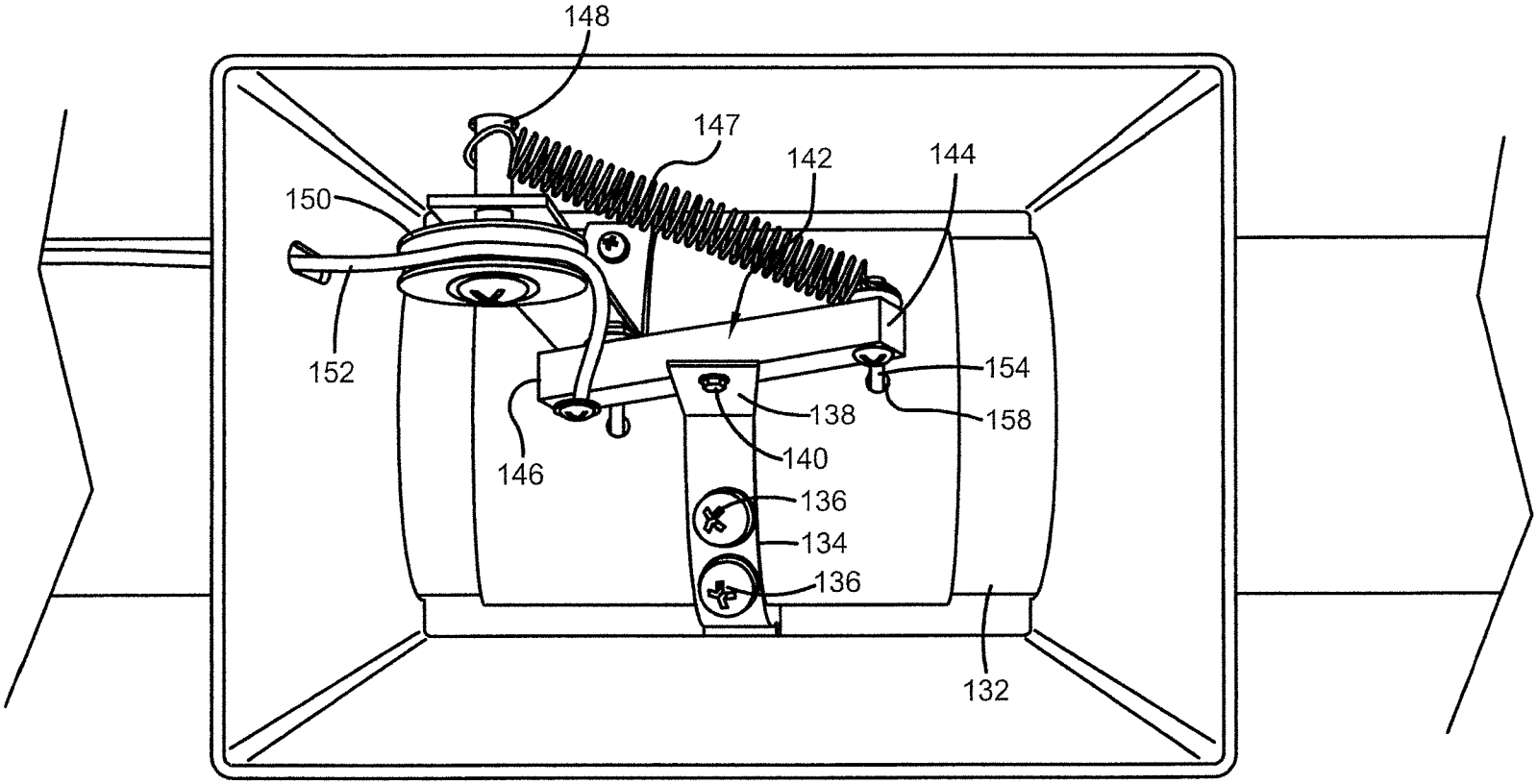
FIG. 3 is a perspective view of a pivoting ball stop of the golf ball reservoir of the golf tee device of the present invention.

Turning to FIGS. 3 and 6, disposed within golf ball reservoir 102 is a pivoting ball stop 142, attached to an outlet tube 132, that controls the release of golf ball 116, from the outlet tube of the golf ball reservoir. Pivoting ball stop 142 is attached to outlet tube 132 by a bracket 134. Bracket 134 is secured to outlet tube 132 by fasteners 136. Bracket 134 further includes a ball-stop pivot bracket 138 that extends outwardly generally perpendicular to the bracket and includes a pivot point 140. Pivot point 140, of ball-stop pivot bracket 138, attaches to pivoting ball stop 142 generally near the midpoint of the pivoting ball stop.

Pivoting ball stop 142 is generally rectangular in shape, and includes an outlet end 144 and an inlet end 146. Near the mid-point of pivoting ball stop 142, there is a pivot point 140, allowing the pivoting ball stop to pivot. Outlet end 144, of pivoting ball stop 142, includes an outlet stop 154 that extends generally perpendicular to the pivoting ball stop. Outlet stop 154 extends through an outlet stop opening 158, through outlet tube 132, to interact with golf ball 116. Further, inlet end 146, of pivoting ball stop 142, includes an inlet stop 156 that extends generally perpendicular to the pivoting ball stop. Inlet stop 156 extends through an inlet stop opening 160 in outlet tube 132 to interact with golf ball 116. The pivoting motion of pivoting ball stop 142 allows for the interaction of inlet stop 156 and outlet stop 154 with golf ball 116.

More specifically, pivoting ball stop 142 is spring biased in a closed position by a spring 147. Spring 147 is attached to outlet end 144 by a fastener (not shown), and attached to interior of golf ball reservoir 102 by a fastener 148. That is, inlet stop 156 extends through inlet stop opening 160, through outlet tube 132, to prevent golf ball 116 from exiting the outlet tube.

Generally, pivoting ball stop 142 is in a spring biased closed position. That is, without user initiation, golf ball 116 will not exit outlet tube 132. In order to activate golf tee device 100 of the present invention, the user must activate the golf tee device.

Upon actuation of golf tee device 100, by pressing plunger 110, pivoting ball stop 142 is moved into an open position. In the open position, inlet end 146 is pulled away from outlet tube 132, by a string 152, thus releasing golf ball 116. Thus, pivoting ball stop 142 pivots along pivot point 140, providing inlet stop 156 to exit outlet tube 132, via inlet stop opening 160, and outlet stop 154 enters the outlet tube through outlet stop opening 158. While pivoting ball stop 142 is in the open position, outlet stop 154 is extended through outlet stop opening 158, to prevent the golf ball from exiting outlet tube 132 through opening 122 too quickly to assist the golf ball being placed on tee (not shown).

Upon release of spring 147, the spring biases pivoting ball stop 142 back to the closed position, withdrawing outlet stop opening 158 from outlet tube 132, and inserting inlet stop 156 through inlet stop opening 160, into the outlet tube preventing plurality of golf balls 116 from exiting the outlet tube.

Figure 4:
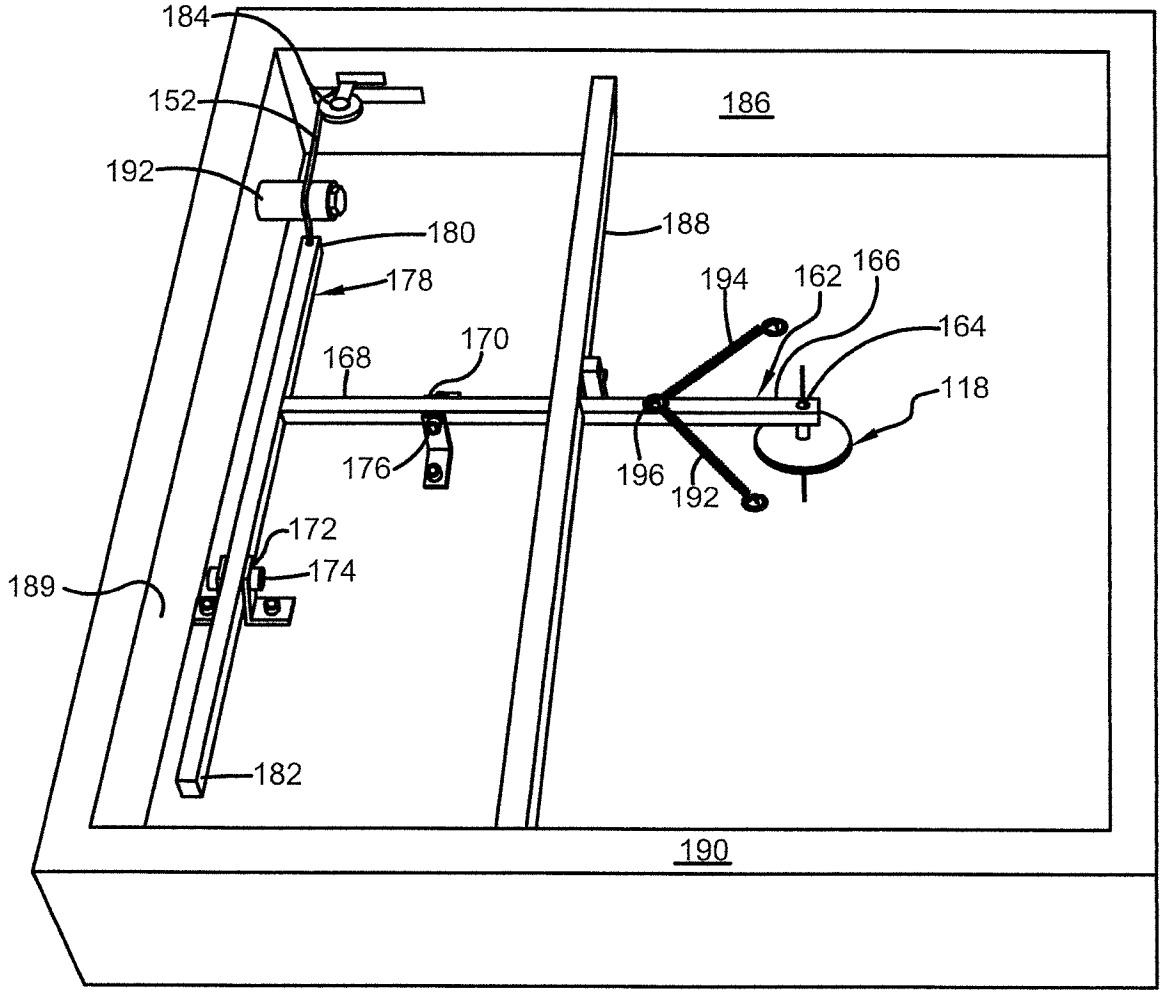
FIG. 4 is a perspective view of the underside of the tee area surface of the golf tee device of the present invention.
Figure 7:
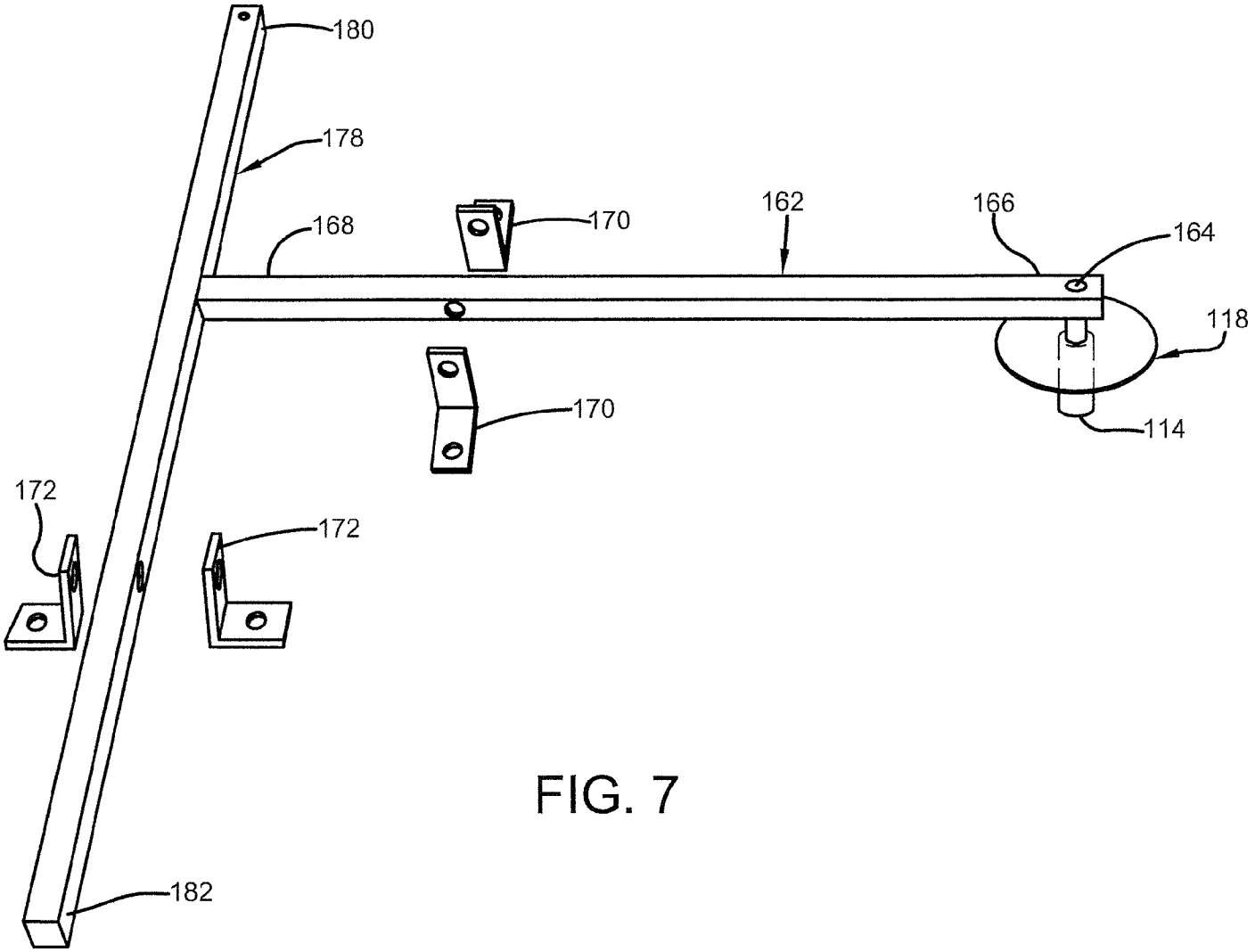
FIG. 7 is a perspective view of the tee area surface showing the interaction of a plunger bar and a tee bar for the golf tee device of the present invention.

Turning to FIGS. 4 and 7, the transfer of energy, from tee activation mechanism 112, through string 152, will be discussed. Tee area 108 includes a rear brace 186, a cross brace 188, a side brace 189, and a front brace 190. Rear brace 186, cross brace 188, side brace 189 and front brace 190 provide support to tee area 108. Further, rear brace 186, cross brace 188, side brace 189 and front brace 190 provide support for a plunger bar 178 and a tee bar 162, as will be discussed. Cross brace 188 and side brace 189 extend generally parallel to one another and are generally perpendicular to rear brace 186 and front brace 190.

Upon user actuation of tee activation mechanism 112 by pressing plunger 110, energy is transferred to plunger bar 178 located within the underside of tee area 108. Plunger bar 178 extends generally parallel to side brace 189 and cross brace 188 of tee area 108 structure. Further, plunger bar 178 includes a front end of plunger bar 182, and a rear end of plunger bar 180. Located approximately a third of a length of plunger bar 178 from front end of plunger bar 182, is a pivot bracket 172. Pivot bracket 172 is attached to plunger bar 178 by a fastener 174 and is also attached to the underside of tee area surface 128. In this manner, plunger bar 172 may pivot when a force is applied to the plunger bar. More specifically, front end of plunger bar 182 is connected by bolts (not shown) to plunger 110 of tee activation mechanism 112. In this manner, energy is transferred from the user through the activation mechanism 112, to plunger bar 178, as will be discussed.

Rear end 180 of plunger bar 178 attaches to string 152 by a fastener (not shown). String 152 extends along a string guide 192 to interact with a pulley 184 before interacting with a pulley 150 (FIG. 3) of golf ball reservoir 102. String guide 192 is generally cylindrical shaped, and prevents string 152 from becoming tangled, or ensnared, with the environment and allows the string to move across string guide towards pulley 184.

Turning to FIGS. 1, 3, 4, and 6, a user actuates tee activation mechanism 112 by pressing plunger 110. By pressing plunger 110, plunger bar 178 pivots at pivot bracket 172. More specifically, front end of plunger bar 182 extends downwardly from tee area 108, and in response, rear end of plunger bar 180 pivots upwardly toward the tee area 108. As rear end of plunger bar 180 pivots upwardly towards tee area 108, string 152 is pulled, as guided by string guide 192. The movement of string 152 extends along pulley 184, to pulley 150, to pivoting ball stop 142, to open the pivoting ball stop as previously discussed.

Turning back to FIGS. 4 and 7, tee bar 162 extends generally perpendicular to plunger bar 178. Tee bar 162 includes a rear end of tee bar 166 and a front end of tee bar 168. Rear end of tee bar 166 is in communication with plunger bar 178, at approximately a third of the length of plunger bar from rear end of plunger bar 180. In this manner, tee bar 162 reacts to the movement of plunger bar 178, as will be described. Further, tee bar 162 extends generally parallel to rear brace 186 and front brace 190. In addition, tee bar 162 is generally perpendicular to cross brace 188 and the cross brace includes a cut-out section to accommodate the tee bar.

Rear end of tee bar 166 is attached to tee mechanism 118 by a fastener 164. Further, at approximately a third of the length of tee bar 162 inwardly from tee mechanism 118, a spring 194 is connected to the tee bar at a spring connection point 196. Spring 194 is biased to maintain tee mechanism 118 generally level to tee area surface 128 (not shown). The tension of spring 194 may be adjusted to alter the force it exerts on tee bar 162, thereby controlling the force and speed of tee mechanism 118 as it rises to the level of tee area surface 128. This prevents golf ball 116 from being tossed upwardly and/or away from tee 114. Further, the angle of pivot allowed by pivot bracket 172 may be adjusted to increase, or decrease, the height of the tee (not shown). In this manner, the user may adjust the tee (not shown) to simulate different conditions upon the golf course.

Towards front end of tee bar 168 is a pivot bracket 170. Pivot bracket 170 is attached to tee bar 162 by a fastener 176. In this manner, tee bar 162 pivots at pivot bracket 170, in reaction to movement of plunger bar 178. More specifically, upon actuation of tee activation mechanism 112, plunger bar 178 pivots, and the movement of the plunger bar transfers energy to tee bar 162, at the intersection of the plunger bar and the tee bar. As a result, tee bar 162 pivots at pivot bracket 170, causing tee mechanism 118 to lower below tee area surface 128 (not shown). At this point, golf ball 116, which was released from golf ball reservoir 102, drops into opening 300 directly above tee mechanism 118 and settles on tee 114. Upon release of plunger 110 of tee activation mechanism 112, tee bar 162 pivots back to a biased position, thereby raising tee mechanism 118 generally level to the tee area surface 128 as a result of spring 194. By design, the top of tee 114 elevates golf ball 116 above the level of tee area surface 128 to simulate the actual game condition. In this manner, user does not have to bend or adjust, to place golf ball 116 on tee 114.

Figure 5:
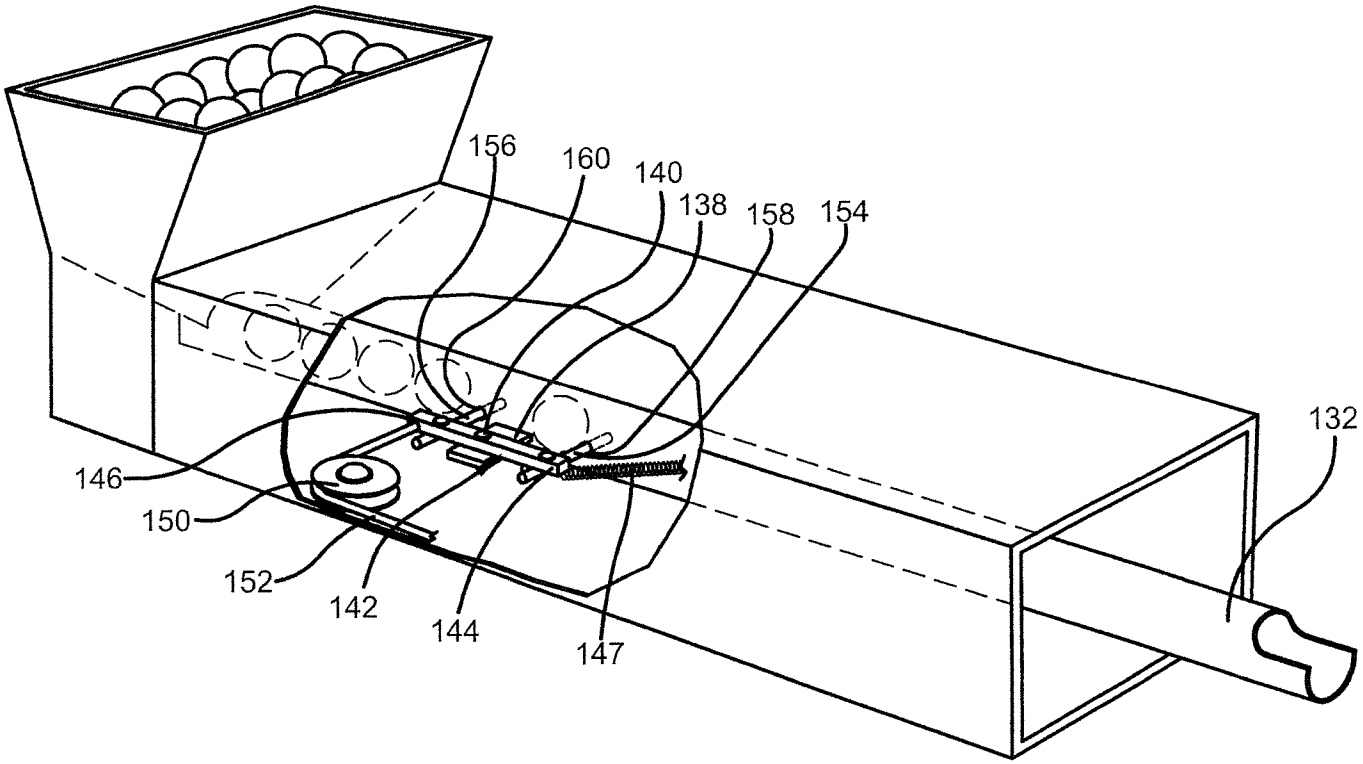
FIG. 5 is a perspective view showing an alternative golf ball reservoir with an enlarged view of the pivoting ball stop.

FIG. 5 shows an alternative embodiment of golf ball reservoir 102 in which a plurality of golf balls 116 may be loaded in a non-linear fashion. In this manner, a user may deposit balls in a disorderly fashion and alternative embodiment of golf ball reservoir is provided to organize plurality of golf balls 116. The alternative embodiment of golf ball reservoir 102 includes pivoting ball stop 142 that operates as previously discussed.

As can be seen from the detailed description, golf tee device 100 of the present invention provides for easy portability and is light weight. In addition, golf tee device 100 is a human-powered device that eliminates the need for a power device. Further, the user does not need to bend down to place a golf ball upon the tee.

It is contemplated that tee bar 162 and plunger bar 178 may be attached by various means without changing the overall concept or operation of the present invention. It is further contemplated that pivot bracket 170 and pivot bracket 172 may be located at different points of the plunger bar 178 and tee bar 162 without changing the overall concept or operation of the present invention. It is even further contemplated that string 152 may be composed of any material known to those in the art, without changing the overall concept or operation of the present invention. It is contemplated that the angle of the golf ball reservoir 102 may be set at different angles without changing the overall concept or operation of the present invention. It is further contemplated that tee area surface 128 and golfer area surface 130 may be composed of any suitable material known to those in the art without changing the overall concept or operation of the present invention. It is even further contemplated that any number of pulleys may be utilized without changing the overall concept or operation of the present invention. It is even further contemplated that channel 120 may be a track or other similar guide without changing the overall concept or operation of the present invention. It is contemplated that the covering of tee area surface 128 and golfer area surface 130 may include any surface known by those in the art without changing the overall concept or operation of the present invention. It is further contemplated that plunger 110 may include other shapes without changing the overall concept or operation of the present invention. It is contemplated that pivot point 140 may be attached to pivoting ball stop 142 at other points without changing the overall concept or operation of the present invention. It is further contemplated that inlet stop 156 and outlet stop 154 may not completely be removed from outlet tube 132 when pivoting ball stop 142 pivots without changing the overall concept or operation of the present invention. It is also contemplated that golf tee device 100 could be made from several parts that are linkable together, where the golf tee device is capable of being folded on top of itself for easy portability, without changing the overall concept or operation of the present invention.

The present invention has been described with reference to a specific embodiment. It is to be understood that this illustration is by way of example and not by way of limitation. Potential modifications and alterations will occur to others upon a reading and understanding of this disclosure, and it is understood that the invention includes all such modifications and alterations and equivalents thereof.

Accordingly, the portable mechanical golf tee device of the present invention is simplified, provides an effective, safe, inexpensive and efficient structure and method which achieves all the enumerated objectives, provides for eliminating difficulties encountered with prior conventional automatic golf tee devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the portable mechanical golf tee device of the present invention is used and installed, the characteristics of the construction, arrangement and method steps, and the advantageous, new and useful results obtained; the new and useful structures, devices, elements, arrangements, process, parts and combinations are set forth in the appended claims.

What is claimed is:

1. A portable, lightweight mechanical golf tee device comprising:

a tee box;

a golf ball reservoir including a container for a plurality of golf balls and a ball stop, said ball stop including a ball-stop pivot bracket pivotally mounted on an outlet tube bracket mounted on an outlet tube, said ball-stop pivot bracket being operatively connected to a tee activation mechanism via a string and a plunger bar, said tee activation mechanism being connected to said plunger bar, said plunger bar being connected to said string, said string being connected to said ball-stop pivot bracket, the string interacting with at least one pulley, said ball-stop pivot bracket including a pair of ends, one end including an inlet stop extending from said ball-stop pivot bracket and the other end including an outlet stop extending from said ball-stop pivot bracket, said inlet stop and said outlet stop alternately extending into and out of said outlet tube when said ball-stop pivot bracket is pivoted by said tee activation mechanism, said golf ball reservoir connected to said tee box; and said tee activation mechanism connected to said tee box, wherein upon user actuation, said tee activation mechanism activates a tee mechanism and also pivots said ball-stop pivot bracket on said outlet tube bracket to selectively release a single ball from said outlet tube onto a channel formed in a surface of said tee box, said tee mechanism raising said golf ball above said surface of said tee box.

2. The portable, lightweight mechanical golf tee device of claim 1, wherein said ball-stop pivot bracket individually releases a first golf ball and holds a second golf ball contained in said outlet tube.

3. The portable, lightweight mechanical golf tee device of claim 1, wherein said tee activation mechanism is a plunger.

4. The portable, lightweight mechanical golf tee device of claim 1, wherein said plunger bar is connected to a tee bar, and said tee bar is connected to said tee mechanism.

5. The portable, lightweight mechanical golf tee device of claim 1, wherein said tee box includes a golfer area and a tee area.

6. The portable, lightweight mechanical golf tee device of claim 1, wherein said tee box includes a golfer area and a tee area, said golfer area including a golfer area surface that mimics a golf course surface.

7. The portable, lightweight mechanical golf tee device of claim 1, wherein said golf tee device further includes a tee area surface, said tee area surface including a channel, said channel guiding said golf ball to a tee of said tee mechanism.

8. The portable, lightweight mechanical golf tee device of claim 1, wherein said golf ball reservoir is inclined from said tee box.

9. The portable, lightweight mechanical golf tee device of claim 1, wherein said golf ball reservoir aligns at least two golf balls in a linear manner.

10. The portable, lightweight mechanical golf tee device of claim 1, wherein said golf ball reservoir is removably connected to said tee box.

11. The portable, lightweight mechanical golf tee device of claim 5, wherein said golfer area and said tee area of said tee box are hingedly connected to one another to allow the tee box to fold onto itself for easy portability.

* * * * *